US007484398B2

(12) United States Patent
Hofmann

(10) Patent No.: US 7,484,398 B2
(45) Date of Patent: Feb. 3, 2009

(54) COMPRESSIVE TOOL

(75) Inventor: Frank Hofmann, Attendorn (DE)

(73) Assignee: Viega GmbH & Co. KG, Attendorn (DE)

( * ) Notice: Subject to any disclaimer, the term of this patent is extended or adjusted under 35 U.S.C. 154(b) by 162 days.

(21) Appl. No.: 11/531,908

(22) Filed: Sep. 14, 2006

(65) Prior Publication Data

US 2007/0068217 A1 Mar. 29, 2007

(30) Foreign Application Priority Data

Sep. 27, 2005 (DE) ..... 10 2005 046 333

(51) Int. Cl.
*B21D 37/10* (2006.01)
*B21D 7/00* (2006.01)

(52) U.S. Cl. ..... 72/416; 72/409.19

(58) Field of Classification Search ..... 72/416, 72/409.01, 409.19, 453.16, 453.15, 402, 72/407, 409.02; 29/237, 243.56; 30/180, 30/187, 228, 245

See application file for complete search history.

(56) References Cited

U.S. PATENT DOCUMENTS 2,022,043 A * 11/1935 Knuutila ..... 72/385
3,057,233 A * 10/1962 Turner ..... 72/409.12
4,109,504 A * 8/1978 Rommel ..... 72/407
4,290,199 A * 9/1981 Hashimoto ..... 30/180
5,138,864 A * 8/1992 Tarpill ..... 72/409.12
6,389,936 B1 * 5/2002 Domenge ..... 81/418
6,779,241 B2 * 8/2004 Mangone, Jr. ..... 29/446
6,971,179 B2 * 12/2005 Erbrick ..... 30/191

FOREIGN PATENT DOCUMENTS

DE 44 46 504 C1 3/1996
DE 19543312 5/1997
DE 19631019 8/1997
DE 100 29 761 C1 10/2001
DE 103 54 307 A1 8/2004
EP 1095739 5/2001

* cited by examiner

*Primary Examiner*—Dana Ross
*Assistant Examiner*—Debra M Sullivan
(74) *Attorney, Agent, or Firm*—Barnes & Thornburg LLP

(57) ABSTRACT

A compressive tool having two jaw halves that run longitudinally from a rear to a front end and are connected to each other in an articulating manner and that can be moved from an open into a closed position. The jaw halves each have an intake contour at the rear end, and cooperate with a displaceable part of a compressive contour such that the displaceable part of the compressive contour, when being displaced longitudinally toward the front end of the jaw halves, will move along the intake contours and force the latter apart in order to move the jaw halves from the open into the closed position. In order to create a compressive tool of simple design with which also to implement in simple manner compressive connections at large nominal pipe widths, the geometry of the rear ends of the jaw halves is selected such that the two jaw halves are able to overlap in the zone of their rear ends when in the open position in a manner that their angle of aperture shall be independent of the course of the particular intake contour.

8 Claims, 5 Drawing Sheets

COMPRESSIVE TOOL

Figure 1:
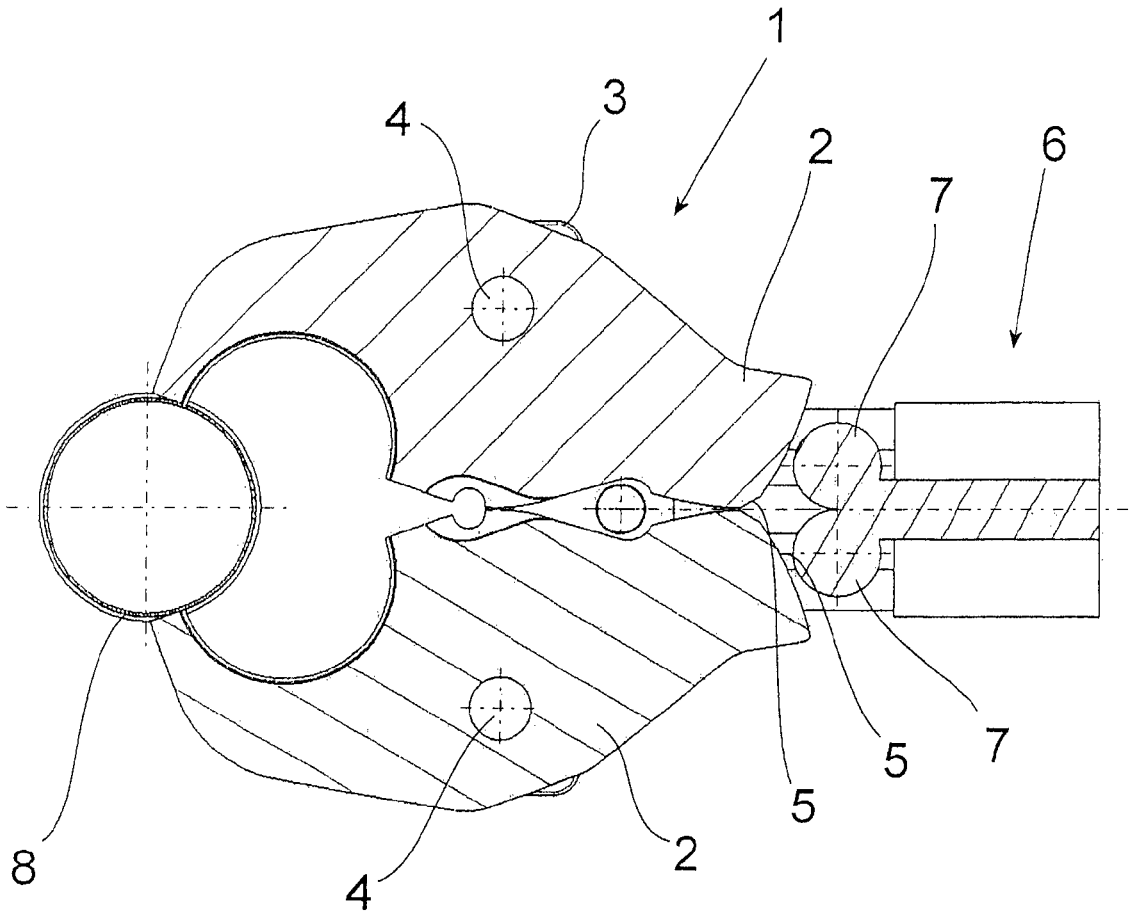
Fig. 1 PRIOR ART

The present invention relates to a compressive tool comprising two halves each running longitudinally from a rear to a front end and connected to each other in articulating manner and displaceable from an open into a closed position, said tool halves each comprising at their rear ends one intake contour, both intake contours cooperating in such manner with a displaceable part of a compressive contour that said displaceable part, when being longitudinally displaced as far as the front ends of the jaw halves shall be displaced along the intake contours and shall force them apart in order to move the jaw halves from the open into the closed position.

Various compressive tools are known in the state of the art to undetachably join by cold forming a fitting to a pipe end inserted into it. After the pipe end has been inserted into said fitting, the compressive tools are used to enclose a specified zone of this fitting with a compressive mouth. In order to implement a cold junction, the enclosed zones of the fitting, such as a bead and its adjoining portions, will be compressed by closing the compressive mouth, as a result of which the fitting and the pipe will be deformed in the area of the compressive mouth.

The nominal widths of the pipe ends inserted into the fitting as a rule involve values up to 54 mm for metal pipes and they are processed with a compressive tool in the form of a so-called jaw fitted with a compressive contour and having two jaw halves running longitudinally from a rear end to a front end. Illustratively the European patent document 1,095,739 B1 discloses a jaw fitted with two halves that in the closed position constitute an annulus. Said two jaw halves are connected to each other in an articulating manner, as a rule by bridging elements configured transversely to the longitudinal direction, one jaw half rotatably resting on one end of each of the bridging elements and the other jaw half on the other ends. The two jaw halves constitute a compressive mouth at the front end of the jaw, said mouth being displaceable from an open into a closed position in order to undetachably join by cold forming the fitting to said pipe end.

An intake contour is provided at the rear ends of the jaw halves, the two intake contours touching each other when the whole jaw is in the open position. The intake contours cooperate in such manner with the compressive contour—of which the displaceable component typically is fitted with rollers—that this displaceable component when being displaced longitudinally to the front ends of the jaw halves shall be displaced along said intake contours and force them apart. A fixed part of the compressive contour is rigidly joined during such a displacement to the bridging elements. The more the rollers force apart the intake contours of the two jaw halves, the more the compressive mouth shall contract until it reaches the closed position of the whole jaw.

However, the above described compressive tool allows only implementing compressive junctions for pipe diameters (to stay with one illustration) no more than 54 mm. As regards pipes of larger rated widths, the fitting segment to be compressed no longer passes through the narrow front part of the compressive mouth. Therefore, tools have been designed for larger rated widths and accordingly special compressive tools are discussed below.

As regards large nominal widths, it is known to lengthen the legs of jaw halves while keeping the aperture angle constant when dealing with small nominal pipe width compressive tool. While on one hand the narrow front zone of the compressive mouth is enlarged thereby, on the other hand the attainable compressive forces in the compressive mouth do decrease clearly as leg length increases. To compensate for the drop in compressive forces, the electro-hydraulic drive of the compressive contour must be commensurately be made larger, entailing an increase in manufacturing costs.

The state of the art also discloses, as in the German patent document 42 40 427 C1, compressive tools for large nominal widths, wherein the compressive mouth is constituted by an annulus of chain links articulating among each other. The individual links of such a compressive chain may be unfolded from each other to receive the fitting. After the fitting has been put in place, the chain links are closed again, i.e. put together, for instance using a separate electrohydraulic closing device in order to close the compressive mouth. Because of this complex design, such a compressive tool also is comparatively expensive. Moreover positioning the compressive chain around the segment to be compressed is comparatively time consuming.

Accordingly it is the objective of the present invention to create a compressive tool of simple design allowing in simple manner to attain compressive junctions also on large nominal pipe widths.

The problem elaborated above is solved by the invention for/and by means of a compressive tool of the initially cited kind in that the geometry of the rear ends of the jaw halves can overlap in the zone of their rear ends when in the open position in a manner that the angle of aperture of the jaw halves shall be independent of the course followed by the particular intake contour. In particular each jaw half is fitted in the zone of its intake contour with at least one recess and one protrusion, the protrusion of one jaw half being opposite the recess of the other. Preferably, the two jaw halves are identical, that is, they are identical in shape and dimensions.

In this manner a compressive tool may be used which offers nearly the same design as the tools employed for nominal widths up to 54 mm, namely a tool of comparatively simple design. However, and contrary to the case of small nominal width compressive tools of the state of the art, the invention offers the feasibility to enlarge the compressive mouth angle of aperture because the rear ends of the jaw halves—where the intake contours are configured—may be moved farther toward each other in the compressive tool's open position. Simultaneously too the present invention also assures that the course of the intake contours, along which the displaceable part of the compressive contour is moved to close the compressive mouth, stays the same as in the known compressive tool.

Accordingly the same compressive contours as before may be used for the compressive tool of the present invention to actuate the jaw in spite of its jaw halves now comprising altered rear ends and thereby larger angles of aperture. Indeed the present invention provides that the intake contours, namely the outer surface of the rear jaw, shall remain unchanged relative to the state of the art on one hand, while simultaneously on the other hand the two rear ends of the jaw halves dip into each other, i.e. engage each other slightly. The larger the recesses at the rear ends of the jaw halves, the larger also the compressive mouth's angle of aperture for the same intake contour.

In one advantageous embodiment mode of the compressive tool of the present invention, the recess and/or the protrusion shall be oblong and in particular shall run longitudinally in the jaw halves.

In another advantageous embodiment mode of the present invention, the width, height and/or length of the recess matches the width, height or length of the particular protrusion. The dimensions of the protrusions shall be selected in a manner that on one hand said protrusion shall enter in problem-free manner the opposite recess, that is without requiring significant force, and on the other hand the protrusion shall be so wide and mechanically strong that the said compressive contour is able to slide along said protrusion and shall be able to transmit a considerable force.

In still another advantageous embodiment mode of the present invention of its compressive tool, the always mutually opposite protrusions and recesses shall complete engage each other when the jaw halves are in the open position. In this manner optimal lateral guidance if the jaw halves at open compressive mouth is also attained at the rear ends of the jaw halves for the open position.

In still a further embodiment mode of the present invention, several recesses and/or several protrusions are used. Preferably each jaw half comprises the same number of recesses and/or protrusions. It was found desirable that each jaw half should comprise one recess and one protrusion or two recesses and two protrusions. The former embodiment variation allows especially simple manufacture, while the latter allows optimized force transmission from the compressive contour to the intake contours.

In still another advantageous embodiment of the present invention, the displaceable component of the compressive contour is designed to make contact only with the protrusions of the jaw halves. However other more elaborate compressive contours also are applicable, of which the displaceable components also would dip into the recesses and in order that the force be transmitted not only by means of the protrusions but also by the recesses to said jaw halves.

In yet another advantageous embodiment of the present invention, the displaceable component of the compressive contour is fitted with rollers able to roll along said protrusions.

Figure 2:
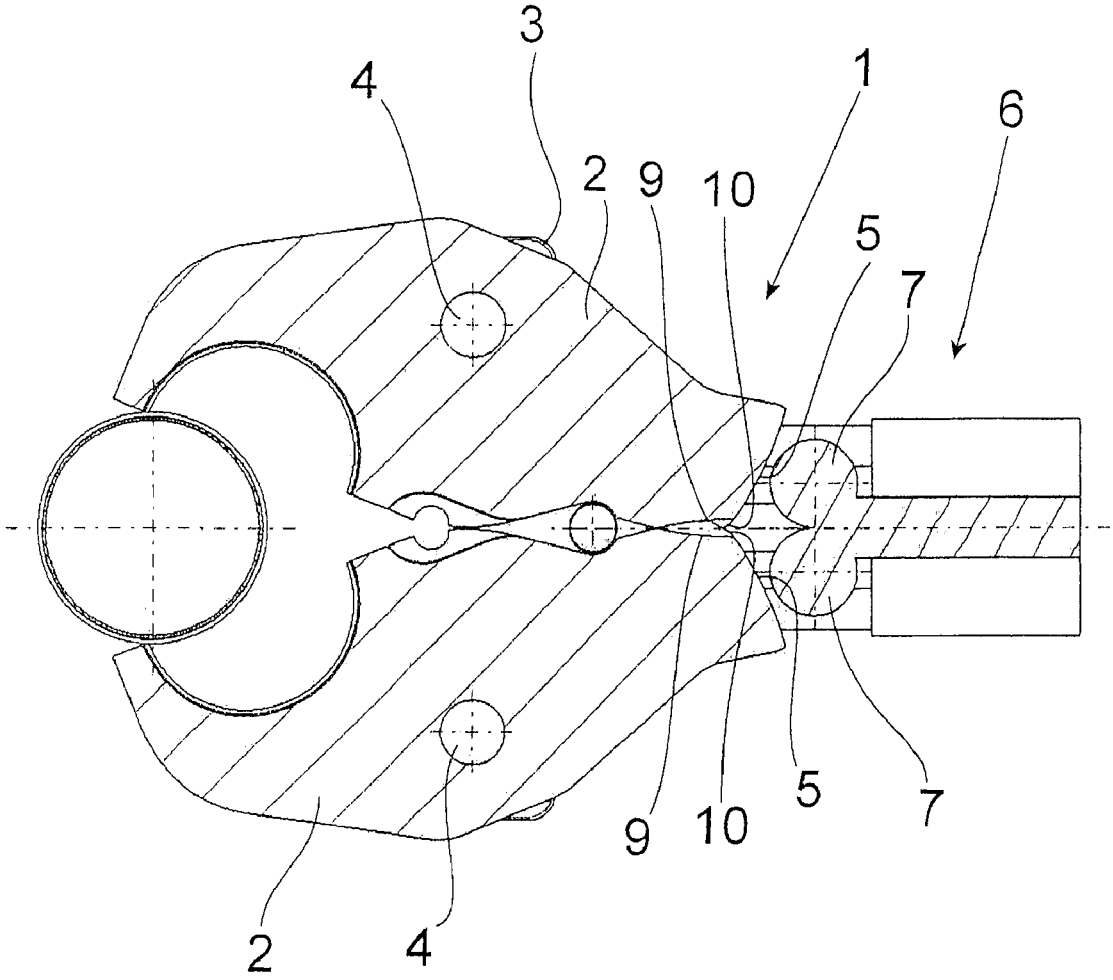
Figure 3:
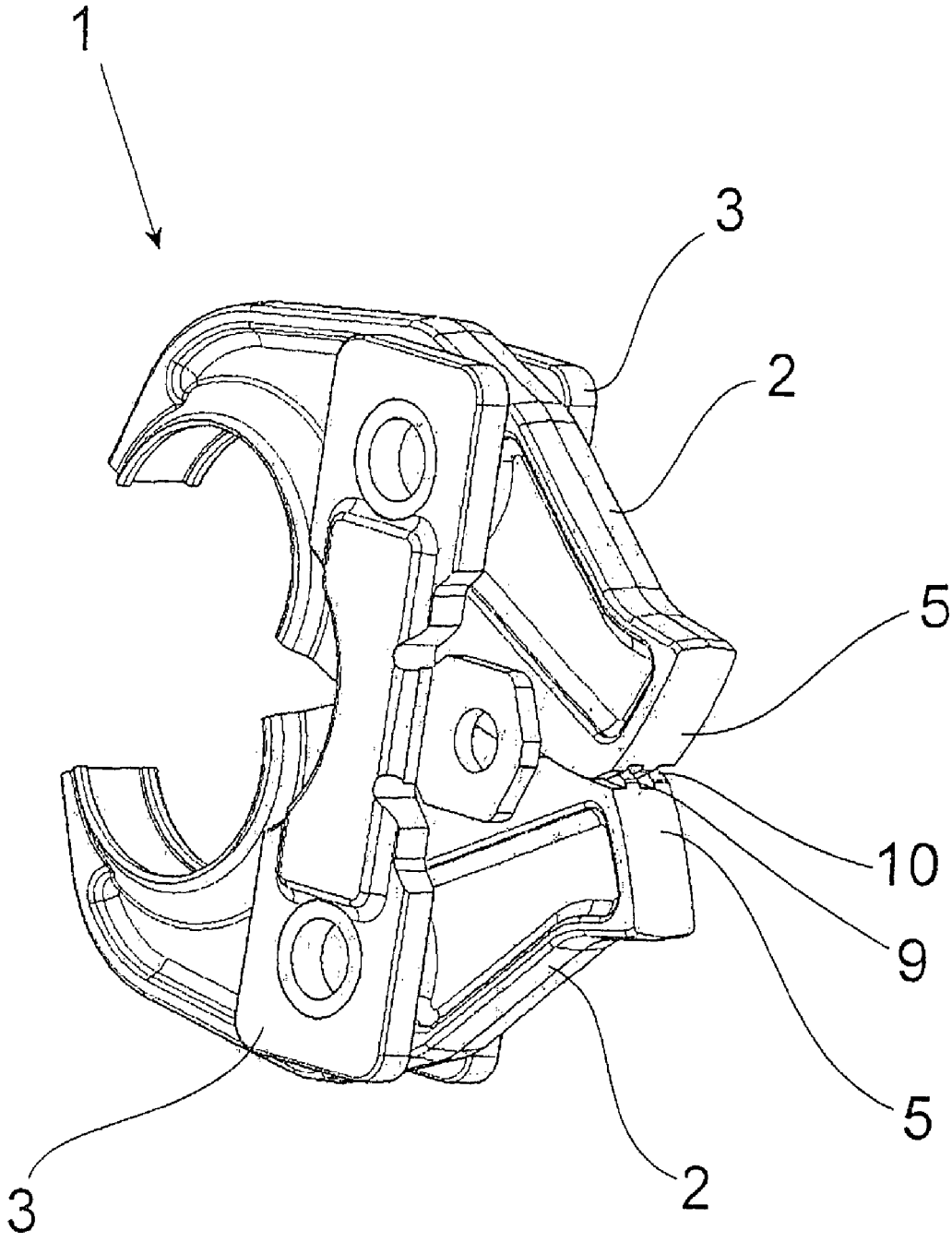
Figure 4:
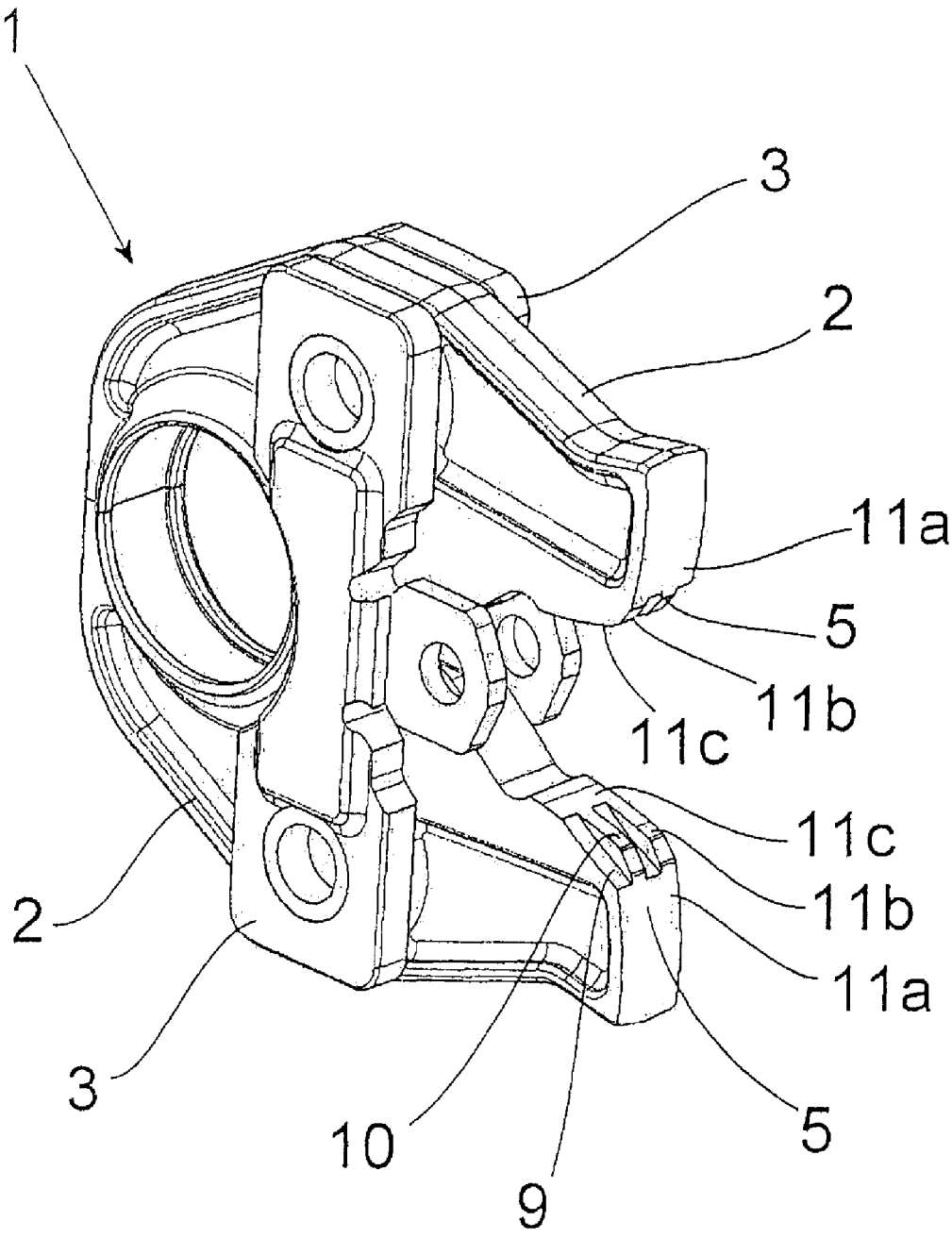
Figure 5:
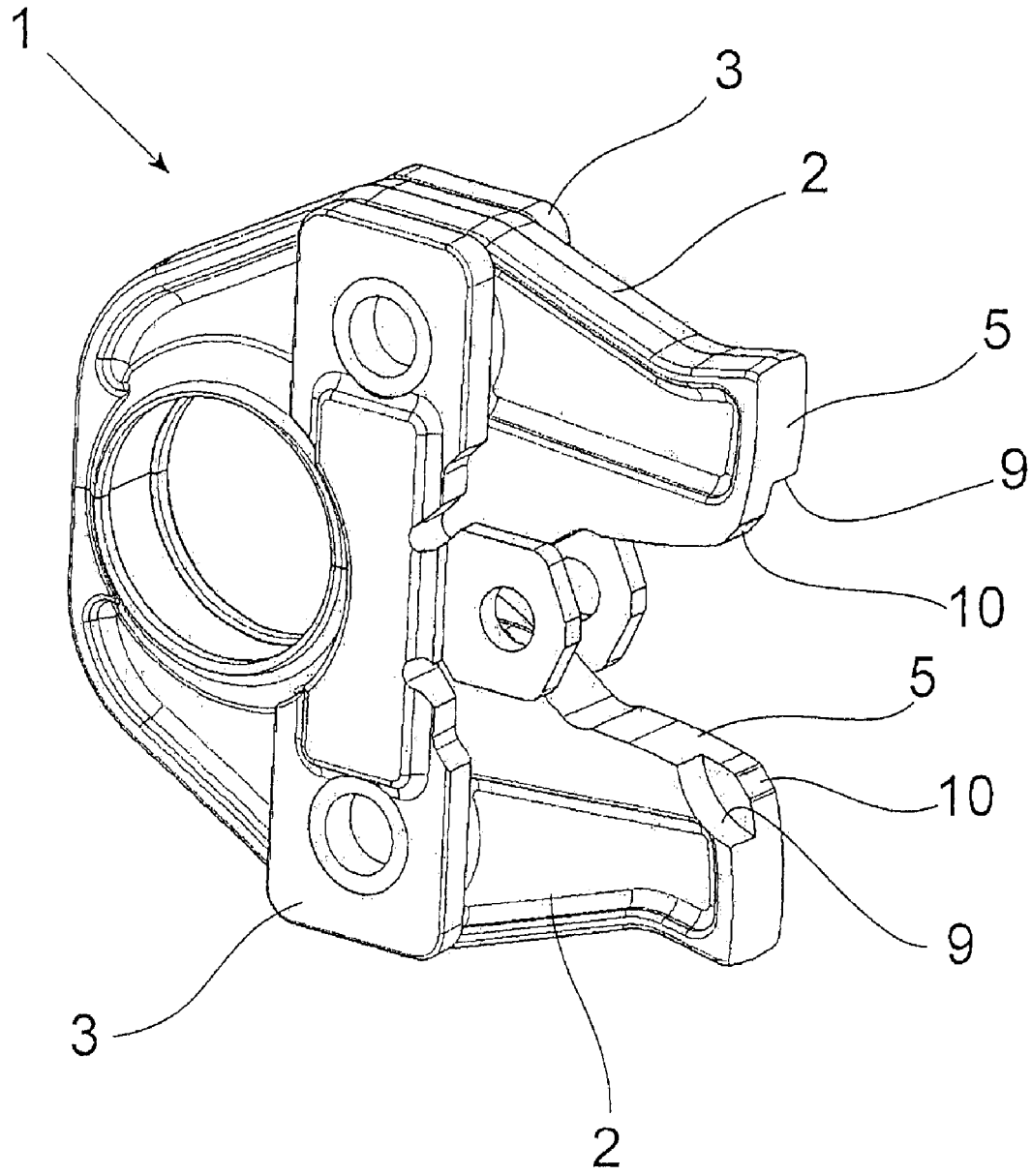

There are many ways to design the compressive tool of the present invention and to develop such designs. Reference is made to the description of illustrative embodiments in relation to the appended drawings:

FIG. 1 is a sectional view of a compressive tool of the state of the art,

FIG. 2 is a sectional view of a first illustrative embodiment of a compressive tool of the present invention, FIG. 3 is a three-dimensional view of the whole jaw of the embodiment of FIG. 2 when in its open position, FIG. 4 is a three-dimensional view of the whole jaw of the embodiment of FIG. 2 when in its closed position, FIG. 5 is a three-dimensional view of the whole jaw of a second illustrative embodiment of the compressive tool of the present invention when in its closed position.

FIG. 1 is a vertical cross-section of a conventional compressive tool 1 comprising a jaw applicable for compressive connections when the pipe ends guided into the fitting may be nominally no larger than 54 mm. The compressive tool comprises two jaw halves 2 running longitudinally from a rear to a front end and connected to each other in articulating manner, namely each jaw half 2 is rotatably supported by bolts 4 on bridge elements 3, of which FIG. 1 only shows the rear one, which connect to each other the jaw halves 2.

This conventional compressive tool 1, i.e. the jaw halves 2, can be moved from an open position where the compressive mouth is maximally open, to a closed position where the compressive mouth is closed and are able to compress a fitting. One intake contour 5 is provided at each end of the two jaw halves 2 and cooperates with a displaceable part of a compressive contour 6, in particular with its rollers 7, as described below. In the open position the intake contours 5 of the particular jaw halves 2 touch each other in a small segment and thereby limit the maximum angle of aperture of the compressive mouth. If, in the open position, the movable part of the compressive contour 6 is displaced longitudinally toward the front end of the jaw halves 2, the immobile part of the compressive contour 6 being firmly connected to the bridging elements 3, then the rollers 7 shall move along the intake contours 5 and force them apart. The jaw halves 2 being connected to each other in articulating manner by means of the bridging elements 3 and the bolts 4, the compressive mouth will be closing commensurately until finally the closed position is reached.

FIG. 1 schematically shows a fitting 8 receiving pipes having nominal diameters larger than 54 mm. It is clear that in spite of the compressive mouth being at its maximum opening, the fitting 8 cannot be inserted between the jaw halves 2 due to its excessive diameter.

FIG. 2 is a sectional view of a first embodiment mode of a compressive tool 1 of the present invention. Basically this compressive tool design is similar to that discussed above in relation to FIG. 1. Again, as regards the compressive tool of the present invention, two jaw halves 2 are connected in articulating manner to each other by bridging elements 3 and bolts 4 and they comprise at their front ends a compressive mouth and at their rear ends intake contours 5 that cooperate by means of rollers 7 with a displaceable part of a compressive contour 6.

FIG. 2 clearly shows that a fitting 8 of the same size as shown in FIG. 1 can be easily inserted into the compressive mouth of the compressive tool of the invention because, in the latter's open position, a larger maximum angle of aperture is reached than in the state of the art.

Said larger angle of aperture is attained because each jaw half 2 is fitted in the zone If its intake contour 5 with recesses 9 and protrusions 10, the protrusions 10 of one jaw half being opposite the recesses 9 of the other.

The design of the invention is elucidated by FIG. 3 showing a three-dimensional view of the jaw of the embodiment of FIG. 2. The mutually opposite recesses 9 and protrusions 10 are clearly shown at the rear ends of the two jaw halves 2 in the zone of the intake contours 5. In the present case the zone of each intake contour 5 comprises two recesses 9 and protrusions 10. The recesses 9 and the protrusions 10 each are elongated and run in the longitudinal direction of the jaw halves 2. The widths, heights and lengths of the recesses 9 precisely match the widths, heights and lengths of the particular opposite protrusions 10. In this manner, when the jaw halves 2 are in the open position shown in FIG. 3, the mutually opposite recesses 2 and the protrusions 10 are able to engage each other completely.

The above described design attains that the jaw halves 2 will slightly overlap at their rear ends in the open position, that is at the maximum angle of aperture, and therefore shall slightly dip into each other, whereas, at the same time, the configuration of the intake contours 5, namely the configuration of the external surfaces of the jaw halves 2 when seen in longitudinal section remain as they are in the state of the art. In this manner the jaw 1 shown in FIG. 3 allows on one hand a larger angle of aperture depending on the depth of the recesses 9 while on the other hand the conventional compressive contour may still be used. No matching of the known compressive contours to the jaws of the present invention or to the compressive tool of the present invention is required.

The closed position attaining maximum compressive effect is shown in FIG. 4 for the above described embodiment. The closed position is attained in that the (omitted) rollers 7 are displaced along the intake contours 5 in the direction of the front ends of the jaw halves 2, as a result of which said jaw halves 2 are forced apart in the zone of their rear ends and are being compressed in the zone of their front ends where, in the present design, the compressive mouth is situated.

The closed position shown in FIG. 4 makes it plain that the rollers 7 of the compressive contour 6 are displaced along the outside surface of the rear ends of the jaw halves 2 which here constitutes a segment of the intake contour 5. In the present case the intake contour 5 is constituted by various segments, namely first an upper segment 11*a* devoid of any recesses, next a segment 11*b* constituted by the protrusions 10 adjoined by the last segment 11*c* which also is devoid of recesses. Grooves are milled into the segment 11*b* constituted by the protrusions 10. Accordingly the compressive force is transmitted by means of the rollers 7 of the compressive contour 6 in the segments 11*a* and 11*c* of the intake contours 5 onto the jaw halves 2 over the latters' entire widths, whereas the force is transmitted in the segment 11*b* only by means of the protrusions 10.

Lastly FIG. 5 shows an alternative embodiment of a compressive tool of the present invention. FIG. 5 shows the jaw, that is the jaw halves 2 connected to each other in articulating manner, in the same way as is FIG. 4, that is in a three-dimensional elevation and in the closed position.

The shown embodiment of FIG. 5 differs from that of FIGS. 2 through 4 by comprising only a single recess 9 and a single protrusion 10 in the zone of the intake contours 5, the particular protrusion of a jaw half 2 being situated opposite the recess of the other jaw half. This embodiment also assures that on one hand that the course of the intake contours coincides with that of the state of the art whereas on the other hand the angle of aperture is larger than in the state of the art because recesses 9 are present in the zone of the intake contours 5 that engage the protrusions 10 of the particular opposite jaw half.

The invention claimed is:

1. A compressive tool extending in a longitudinal direction from a rear end to a front end at which a compressive mouth is provided, the compressive tool comprising:

a pressing contour including a displaceable part, two jaw halves which run in the longitudinal direction from the rear end to the front end and which are connected to each other, with the jaw halves being pivotable around a pivot axis extending perpendicular to the longitudinal direction and being displaceable from an open position to a closed position, at which open position the front ends of the jaw halves have a maximum angle of aperture at the compressive mouth, wherein said jaw halves each are fitted at its rear end with an intake contour, wherein both intake contours cooperating in such manner with the displaceable part of the pressing contour that said displaceable part, when being displaced parallel to the longitudinal direction to the front ends of the jaw halves, shall be moved in the longitudinal direction and along both intake contours in order to move the jaw halves from the open position into the closed position, wherein the rear ends of the jaw halves are configured such that the two jaw halves overlap in a direction defined by the pivot axis in a zone of the rear ends, wherein at an outer surface of each of the rear ends of the jaw halves that defines the intake contour there is provided at least one recess and at least one protrusion, wherein the at least one protrusion of one intake contour is situated opposite the at least one recess of the other intake contour, and wherein in the open position the rear ends of the jaw halves dip into each other beyond a point at which the intake contours would contact each other in an absence of the recesses and protrusions.

2. The compressive tool as claimed in claim 1, wherein one of the at last one recess and the at least one protrusion each is elongated and runs in the longitudinal direction of the jaw halves.

3. The compressive tool as claimed in claim 1, wherein one of a width, height and length of the at least one recess matches a corresponding width, height and length of the corresponding opposite at least one protrusion.

4. The compressive tool as claimed in claim 1, wherein, in the open position of the jaw halves, a mutually opposite protrusion and recess engage each other completely.

5. The compressive tool as claimed in claim 1, wherein the at least one recess includes a plurality of recesses and the at least one protrusion includes a plurality of protrusions.

6. The compressive tool as claimed in claim 1, wherein a number of recesses and protrusions of one of the jaw halves equals a corresponding number of recesses and protrusions of the other of the jaw halves.

7. The compressive tool as claimed in claim 1, wherein the displaceable part of the pressing contour is designed in a manner that it comes into contact only with the at least one protrusion of each of the jaw halves.

8. The compressive tool as claimed in claim 1, wherein the displaceable part of the pressing contour includes rollers configured to roll along the protrusions.

* * * * *